US011092380B2

(12) United States Patent
Kibel et al.

(10) Patent No.: US 11,092,380 B2
(45) **Date of Patent: *Aug. 17, 2021**

(54) METHOD OF DRYING FRAC SAND WITHOUT HEAT

(71) Applicant: R.T.D. Enterprises, Madison, ME (US)

(72) Inventors: Robert E. Kibel, Madison, ME (US); Daniel M. Salsinger, Elmhurst, IL (US)

(73) Assignee: R.T.D. Enterprises, Madison, ME (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/818,983

(22) Filed: Mar. 13, 2020

(65) Prior Publication Data

US 2020/0217586 A1 Jul. 9, 2020

Related U.S. Application Data

(62) Division of application No. 15/850,203, filed on Dec. 21, 2017, now Pat. No. 10,634,427.

(51) Int. Cl.

| | |
|---|---|
| ***F26B 5/00*** | (2006.01) |
| ***F26B 9/10*** | (2006.01) |
| ***E02B 11/00*** | (2006.01) |
| ***B08B 3/10*** | (2006.01) |
| *B03B 5/00* | (2006.01) |

(52) U.S. Cl.

CPC ..... *F26B 5/00* (2013.01); *B08B 3/10* (2013.01); *E02B 11/00* (2013.01); *E02B 11/005* (2013.01); *F26B 9/10* (2013.01); *B03B 5/00* (2013.01); *F26B 2200/14* (2013.01)

(58) Field of Classification Search

CPC ..... E02B 11/00; E02B 11/005; F26B 5/00; F26B 9/10

USPC ..... 405/43–45, 50, 302.6, 302.7

See application file for complete search history.

(56) References Cited

U.S. PATENT DOCUMENTS

| | | | |
|---|---|---|---|
| 3,802,144 | A | 4/1974 | Spica |
| 4,468,910 | A | 9/1984 | Morrison |
| 4,632,764 | A | 12/1986 | Riise |
| 4,832,526 | A | 5/1989 | Funkhouser, Jr. |
| 4,965,097 | A | 10/1990 | Bach |

(Continued)

FOREIGN PATENT DOCUMENTS

| | | |
|---|---|---|
| FR | 2559401 | 8/1985 |

*Primary Examiner* — Frederick L Lagman

(74) *Attorney, Agent, or Firm* — Gunn Lee & Cave PC

(57) ABSTRACT

A method of drying frac sand without heat is comprised of constructing a drainage system and placing sand on top of a perforated top layer thereon. The drainage system has multiple layers through which liquid passes to dewater sand resting thereon. At the bottom of the drainage system, perforated collection pipes, at least partially surrounded by rocks, collect and carry the liquid to a collection pond for reuse. A cellular confinement layer has sections of panels which, upon expansion, have cells filled with rocks. A woven monofilament geotextile fabric layer comprising woven monofilament geotextile fabric sheets sewn together has sized openings which allow fluid, but prevent sand from passing through the openings. The top layer comprises high density polyethylene perforated sheets welded together. A watertight liner sits below the collection pipes and the cellular confinement layer. Protective layers above and below the watertight liner prevent rocks from damaging same.

6 Claims, 11 Drawing Sheets

(56) References Cited

U.S. PATENT DOCUMENTS

| | | | | |
|---|---|---|---|---|
| 5,787,654 | A | 8/1998 | Drost | |
| 5,848,856 | A | 12/1998 | Bohnhoff | |
| 6,051,137 | A | 4/2000 | Deskins | |
| 6,221,445 | B1 | 4/2001 | Jones | |
| 6,450,731 | B1 | 9/2002 | Bohnhoff | |
| 6,779,946 | B1 | 8/2004 | Urriola | |
| 7,290,958 | B2 | 11/2007 | Blackwood | |
| 7,494,592 | B2 | 2/2009 | Deskins | |
| 7,578,635 | B2 | 8/2009 | Blackwood | |
| 7,691,261 | B2 | 4/2010 | Deskins | |
| 8,336,146 | B1 | 12/2012 | Berbash | |
| 9,206,559 | B2 | 12/2015 | Bach et al. | |
| 9,322,595 | B1 | 4/2016 | Shinn | |
| 9,675,907 | B2 | 6/2017 | Deskins | |
| 9,909,266 | B1 | 3/2018 | Stiles | |
| 10,400,417 | B1 | 9/2019 | Dawson | |
| 10,634,427 | B2 * | 4/2020 | Kibel | E02B 11/005 |
| 2007/0284302 | A1 | 12/2007 | Blackwood | |
| 2013/0209179 | A1 | 8/2013 | Erez | |
| 2013/0309758 | A1 | 11/2013 | Erasmus | |
| 2018/0369721 | A1 | 12/2018 | Burns | |
| 2019/0177199 | A1 | 6/2019 | Deskins | |
| 2019/0211514 | A1 | 7/2019 | Jones | |
| 2019/0352859 | A1 | 11/2019 | Hartman | |

* cited by examiner

METHOD OF DRYING FRAC SAND WITHOUT HEAT

CROSS REFERENCE TO RELATED APPLICATIONS

This is a divisional application claiming priority to and the benefit of U.S. application Ser. No. 15/850,203, filed Dec. 21, 2017 now U.S. Pat. No. 10,634,4217, and entitled "Drainage System and Method of Drying Frac Sand," which is hereby incorporated by reference herein.

FEDERALLY SPONSORED RESEARCH OR DEVELOPMENT

Not applicable.

BACKGROUND OF THE INVENTION

1. Field of the Invention

This invention relates generally to an apparatus and method for drying sand used in fracking.

2. Description of the Related Art

Frac sand is a pure quartz sand with durable round grains and is a crush-resistant material used by the petroleum industry. It is used in a hydraulic fracturing process, known as "fracking", to produce petroleum fluids including natural gas, oil from rock formations which lack adequate pore space for these petroleum fluids to flow to a well. The hydraulic fracturing process generates fractures in the rock by drilling a well into the rock, sealing the well in the petroleum-bearing zone of the well and pumping liquid into the petroleum-bearing zone of the well. The liquid is treated with chemicals and has frac sand mixed therein. Large pumps above ground increase the pressure in the sealed portion of the well until the pressure exceeds the breaking point of the rocks. When the rocks fracture, the liquid containing frac sand enters the fractures. The pressure is then relieved by turning the pumps off. The frac sand inside the rock fractures must be great enough to keep the fractures open. Because the frac sand props the fractures open, it is known as a "proppant" in the industry. Frac sand is a highly pure silica sand ranging in diameter from 0.1 millimeter to over two millimeters.

The demand for frac sand has increased in the past few years because more and more oil and natural gas wells use fracking. A hydraulic fracturing job on one well can require a few thousand tons of sand.

Frac sand requires processing after being mined to optimize its performance. At a processing plant, the frac sand is washed to remove fine particles. After washing, the sand is stacked in piles to allow the water to drain through the pile faster. However, such drainage takes time and often does not dry the frac sand adequately. After being partially dried, the sand is placed in a rotary dryer. Operating a rotary dryer requires a great deal of energy because the frac sand entering the rotary dryer is wetter than desired. Its moisture content would preferably be lower entering the rotary dryer, thereby reducing the time required for the frac sand to be inside the rotary dryer to achieve the desired moisture content.

Therefore, there is a need for a drainage system for drying frac sand in less time than known drainage systems.

There is further a need for a drainage system for drying frac sand which uses gravity and costs less than known systems.

There is further a need for a method of drying frac sand which uses less energy than known drying methods.

BRIEF SUMMARY OF THE INVENTION

According to one aspect of the invention, a drainage system for drying frac sand without heat comprises multiple layers above a waterproof liner. The system may be any desired size, but is typically at least one acre. The bottom waterproof layer keeps ground water from entering the drainage system and fluid used to wash the frac sand from entering the ground water.

The top layer is a perforated layer comprising sheets of high density polyethylene welded together. The layer immediately below the perforated top layer comprises a woven monofilament geotextile fabric layer. The woven monofilament geotextile fabric layer comprises woven monofilament geotextile fabric sheets sewn together. The woven monofilament geotextile fabric sheets have openings therethrough. The next lowest layer comprises a cellular confinement layer below the woven monofilament geotextile fabric layer. The cellular confinement layer comprises sections joined together with keys. Each section comprises panels joined together. When the sections of the cellular confinement layer are expanded, cells between the wave-shaped plastic panels are filled with rocks. Perforated collection pipes reside below the cellular confinement layer for capturing liquid and carrying the captured liquid to a collection pond for reuse. Rocks at least partially surround the collection pipes.

A watertight liner resides below the perforated collection pipes and below the rock containment layer. The drainage system further comprises protective layers above and below the watertight liner to prevent the rocks from damaging the watertight liner.

In a second aspect, a drainage system for drying frac sand without heat comprises a perforated top layer at the top of the drainage system. A woven monofilament geotextile fabric layer is located below the perforated top layer, the woven monofilament geotextile fabric layer comprising woven monofilament geotextile fabric sheets having openings sewn together. A cellular confinement layer is located below the woven monofilament geotextile fabric layer, the cellular confinement layer comprising wave-shaped panels joined together. Cells between the wave-shaped plastic panels are filled with rocks. Perforated collection pipes are located below the cellular confinement layer for capturing liquid and carrying the captured liquid to a collection pond for reuse. Rocks at least partially surround the collection pipes. A watertight liner resides below the perforated collection pipes and below the cellular confinement layer. Protective layers are above and below the watertight liner to prevent the rocks from damaging the watertight liner. The protective layers are preferably made of non-woven geotextile fabric.

In a third aspect, a method of drying frac sand without heat comprises constructing a drainage system, placing sand on top of the drainage system and washing the sand. The drainage system comprises a perforated top layer. A woven monofilament geotextile fabric layer having openings therethrough resides below the perforated top layer. The woven monofilament geotextile fabric layer comprises woven geotextile fabric sheets sewn together. The third layer down comprises a cellular confinement layer below the woven monofilament geotextile fabric layer. The cellular confinement layer comprises wave-shaped plastic panels joined together. The cells between the wave-shaped plastic panels are filled with rocks. Perforated collection pipes are located below the cellular confinement layer for capturing liquid and carrying the captured liquid to a collection pond for reuse. Rocks at least partially surround the collection pipes. The drainage system further comprises a watertight liner below the perforated collection pipes and below the cellular confinement layer. Protective layers above and below the watertight liner prevent the rocks from damaging the watertight liner. The protective layers are each made of non-woven geotextile fabric.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
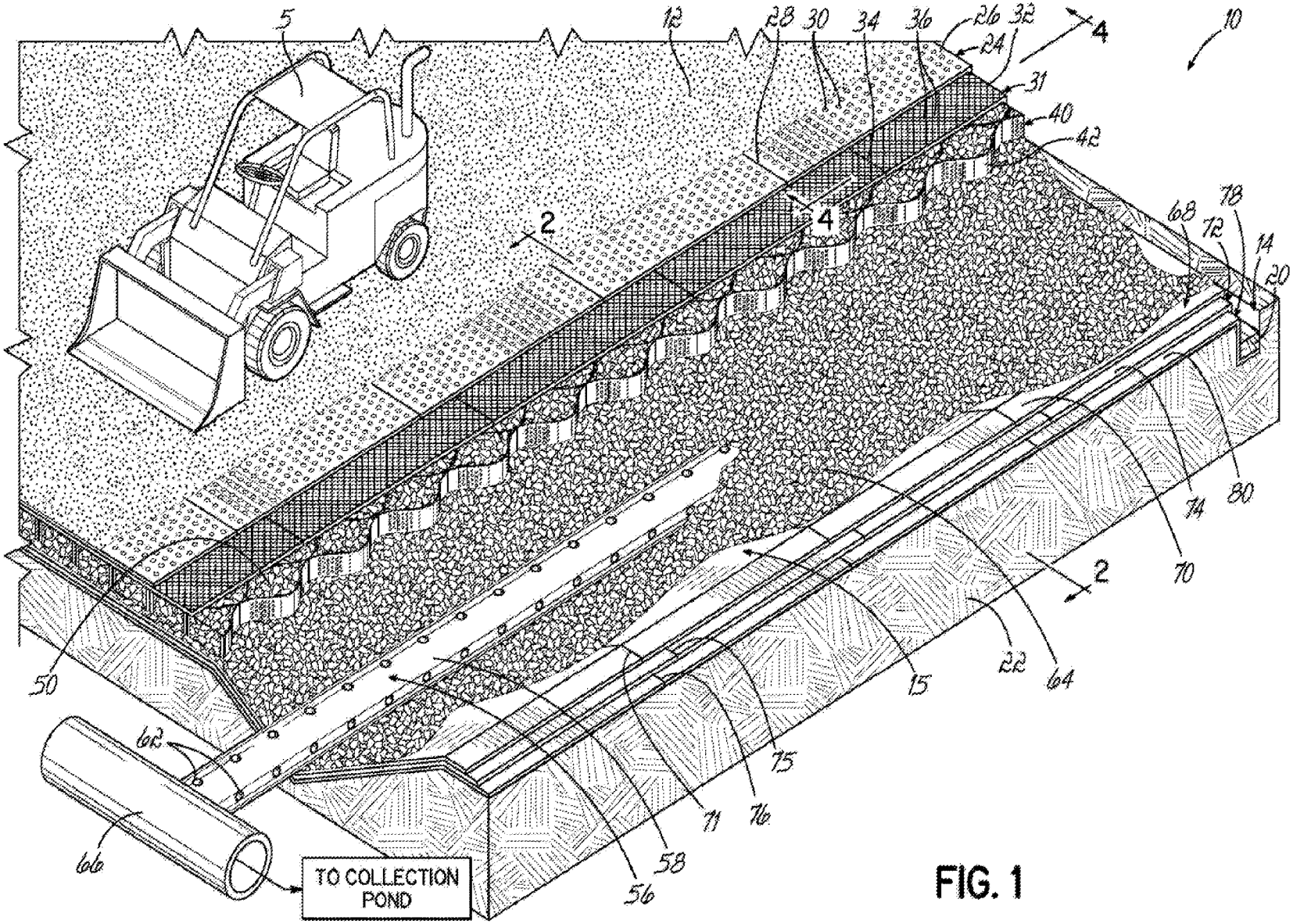
FIG. 1 is a perspective view, partially cut away, of a drainage system in accordance with the present invention.
Figure 2:
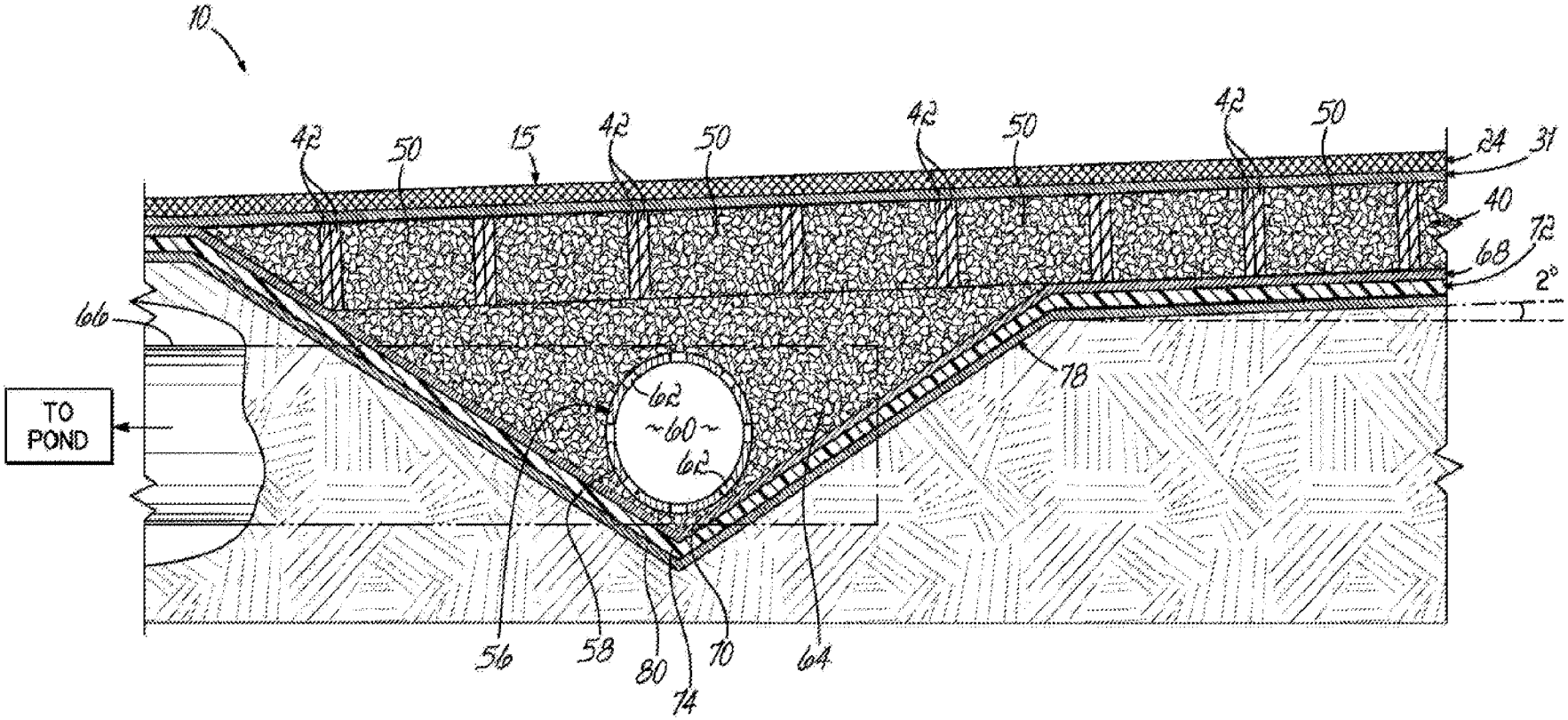
FIG. 2 is a cross-sectional view taken along the line 2-2 of FIG. 1.
Figure 4:
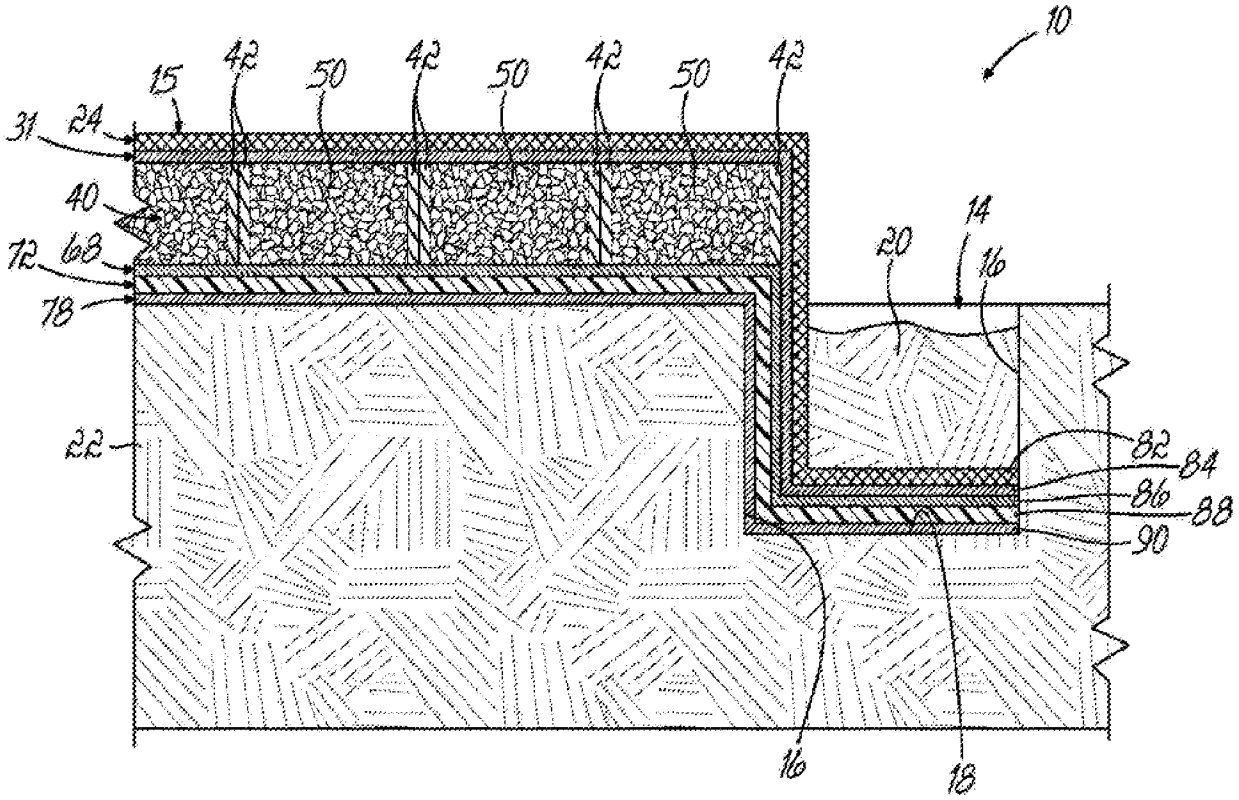
FIG. 4 is a cross-sectional view taken along the line 4-4 of FIG. 1.

Referring first to FIGS. 1 and 2, there is illustrated a drainage system 10 for drying frac sand 12 without heat. As best shown in FIGS. 1 and 4, the drainage system 10 has an anchor trench 14 surrounding an interior portion 15 of the drainage system 10. The anchor trench 14 extends around the perimeter of the interior portion 15 of the drainage system 10 (only one side being shown) and extends down into the soil 22.

As best shown in FIG. 4, the anchor trench 14 has two side walls 16 and a bottom 18. The anchor trench 14 is created by removing dirt from the perimeter of the drainage system 10. As described below, after the drainage system 10 is partially created, dirt is placed back inside the anchor trench 14 to create an anchor of dirt 20 which holds down and secures the perimeter of multiple layers of the drainage system 10. Although one shape of anchor trench 14 is illustrated, the anchor trench may be other shapes, such as more rounded like a conventional trench. The anchor trench 14 is not intended to be limited by the drawings.

The drainage system 10 may be any desired size, but is typically between one to three acres in size. Any of the drainage systems described or shown herein is strong enough to support a piece of sand moving equipment 5 weighing thousands of pounds. See FIG. 1.

As best shown in FIG. 1, moving from top to bottom, the drainage system 10 comprises a top layer 24 upon which the frac sand 12 to be dried is placed. The top layer 24 of the drainage system 10 is made of high density polyethylene sheets 26 welded together along weld lines 28. Each of the high density polyethylene sheets 26 may be any desired thickness, but are preferably in the range of between 50 mils (0.050 inches) to 80 mils (0.080 inches) thick. The high density polyethylene sheets 26 are typically fifteen (15) feet wide, but may be any desired width. The high density polyethylene sheets 26 may be any desired lengths. High density polyethylene sheets which have proven to be satisfactory are available from Presto GeoSystems of Appleton, Wis.

Each of the high density polyethylene sheets 26 has multiple openings 30 therethrough, meaning each of the high density polyethylene sheets is perforated. Although the openings 30 are illustrated being circular, they may be any desired shape and any desired size. For purposes of this document, the word "perforated" means that fluid may flow through the object being described. Thus, fluid may flow through each high density polyethylene sheet 26 described as perforated. It is preferable that each of the high density polyethylene sheets 26 be perforated. However, it is within the scope of the present invention that not all of the high density polyethylene sheets 26 be perforated.

As best shown in FIGS. 1 and 2, a second or woven monofilament geotextile fabric layer 31 immediately below the top layer 24 comprises woven monofilament geotextile fabric sheets 32 sewn together along sewn lines 34 at the site of the drainage system 10. Each of the woven monofilament geotextile fabric sheets 32 has openings 36, such that each woven monofilament geotextile fabric sheet 32 is perforated and allows fluid to flow through the sheet. It is preferable that each of the woven monofilament geotextile fabric sheets 32 be perforated and suitable for a specific job site. In other words, the percent of woven monofilament geotextile fabric sheet 32 which is open varies and is selected based on the sand at a specific location. The size of the openings 36 in the woven monofilament geotextile fabric sheets 32 is preselected to allow fluid to pass through the openings 36, but not the grains of sand. However, it is within the scope of the present invention that not all the woven monofilament geotextile fabric sheets 32 be perforated. Woven monofilament geotextile fabric sheets which have proven satisfactory are available from Tencate Geosynthetics of Pendergrass, Ga. and sold under the mark Mirafi®.

The woven monofilament geotextile fabric sheets 32 are preferably made of polypropylene, but may be made of other perforated material. The woven monofilament geotextile fabric sheets 32 are typically fifteen (15) feet wide, but may be any desired width. The woven monofilament geotextile fabric sheets 32 are typically 300 feet in length, but may be any desired length. The process of sewing the woven monofilament geotextile fabric sheets 32 together along prayer seams occurs on site, in other words at the site of the drainage system 10. The woven monofilament geotextile fabric sheets 32 are trucked onto the site in rolls and unrolled at the site of the drainage system 10.

Figure 7:
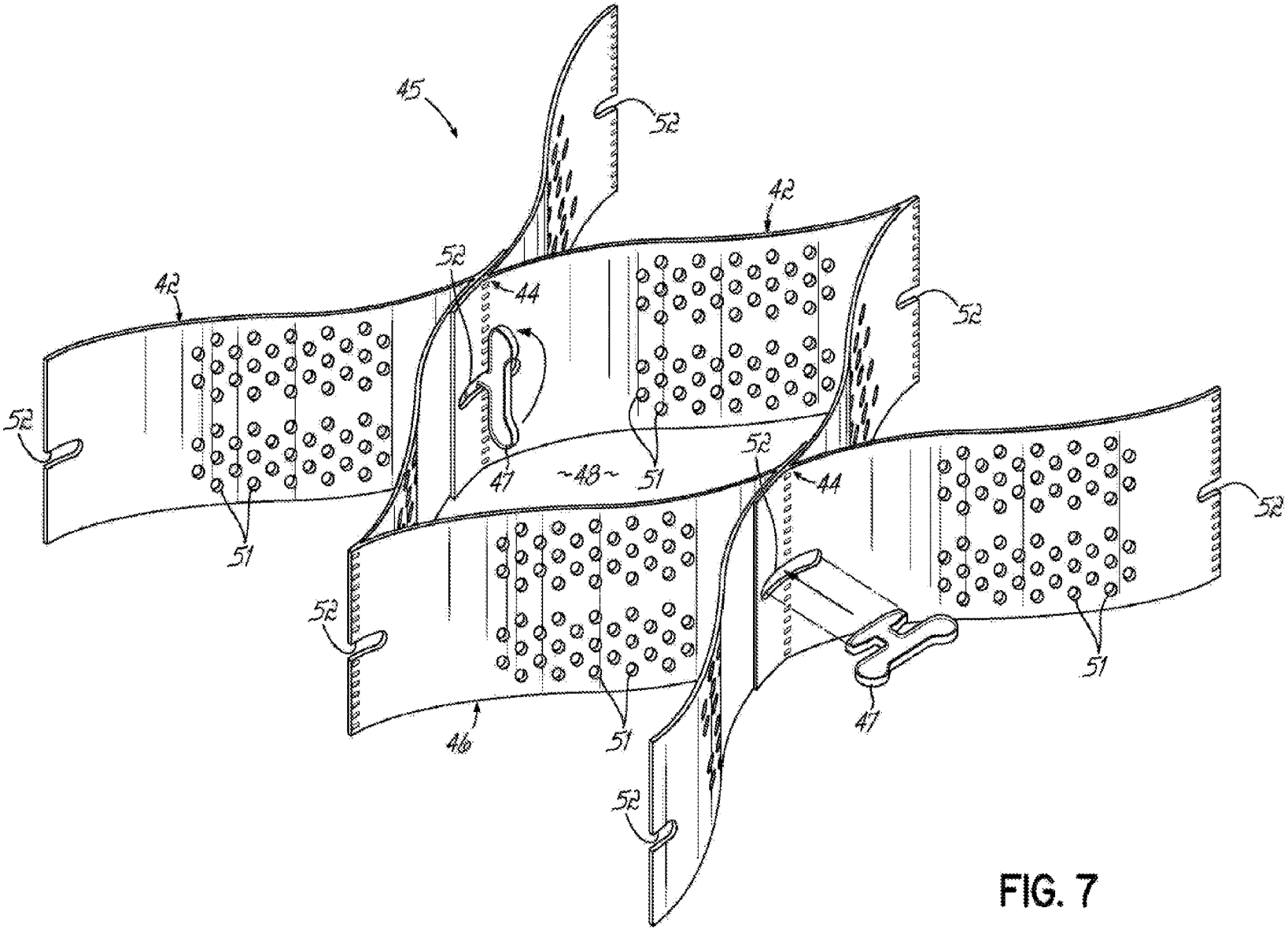
FIG. 7 is an enlarged view of two sections of the cellular confinement layer of the drainage system of FIG. 1 in expanded positions and joined with keys.
Figure 8:
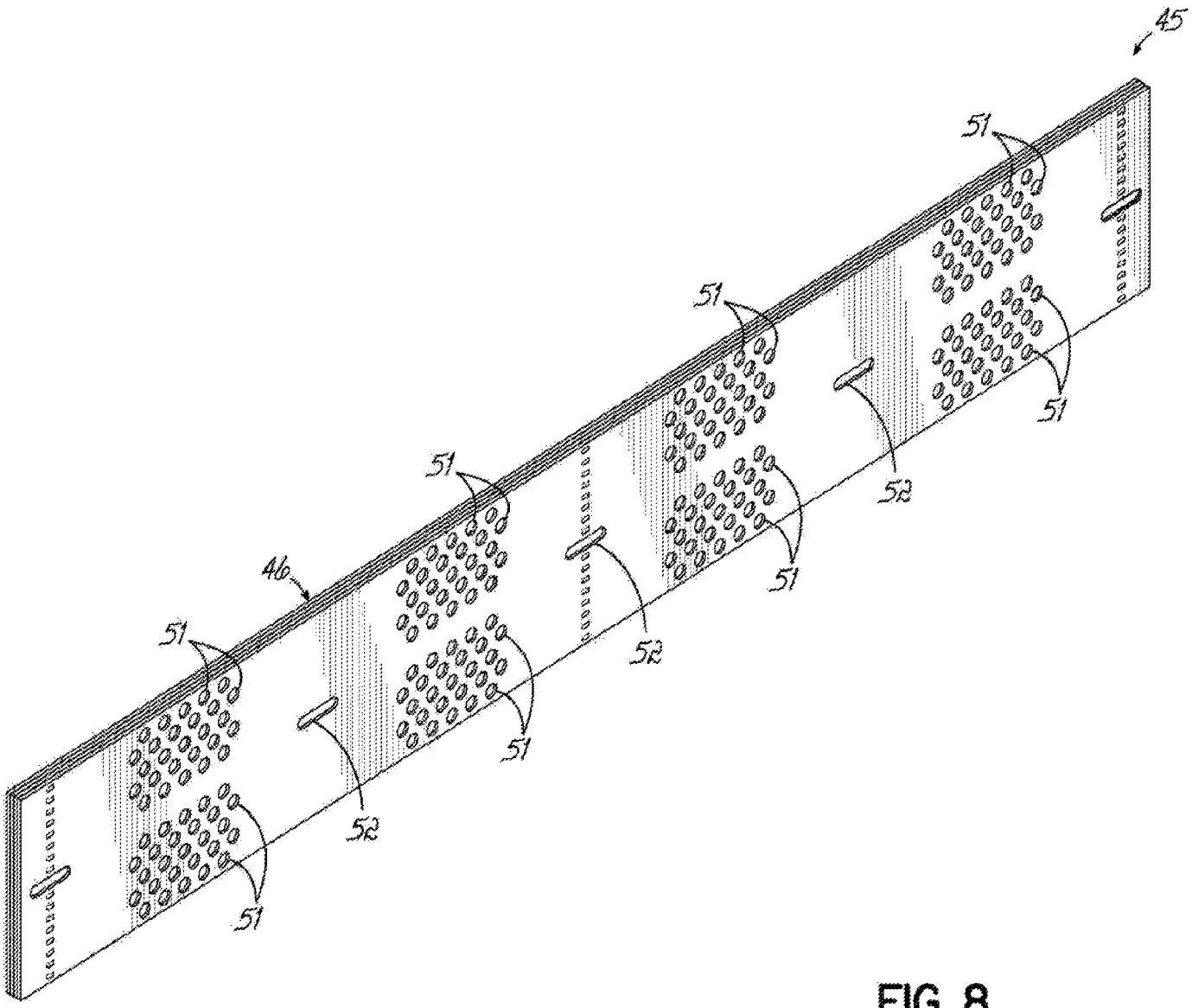
FIG. 8 is an enlarged view of a section of the cellular confinement layer of the drainage system of FIG. 1 in a collapsed position.

The core layer of the drainage system 10 is a cellular confinement layer 40 located below the woven monofilament geotextile fabric layer 30. As best shown in FIG. 7, the cellular confinement layer 40 comprises multiple cellular confinement sections 45 joined together with keys 47. As best shown in FIG. 7, each cellular confinement section 45 comprises plastic panels 42, 43 joined together at locations 44 to create a matrix 46. The matrix 46 is movable between a collapsed position shown in FIG. 8 and an expanded position shown in FIG. 7. When the matrix 46 is in its expanded position, the panels 42, 43 are wave-shaped defining cells 48 therebetween. The plastic is preferably high density polyethylene, but may be any desired plastic. The matrix 46 is illustrated with the panels 42, 43 being the same height. In one embodiment, the panels 42, 43 are eight inches high, so the cellular confinement layer 40 is eight inches tall. However, the cellular confinement layer 40 may be any desired height such as four or six inches. Preferably, panels 42, 43 are the same height. However, they may be different heights.

As best shown in FIGS. 1 and 2, rocks 50 fill the voids of the matrix 46 of the cellular confinement layer 40. The rocks 50 are preferably size 57 hard stone, but may be any other desired size. The rocks 50 are only shown in one cell 48 of FIG. 6.

Figure 6:
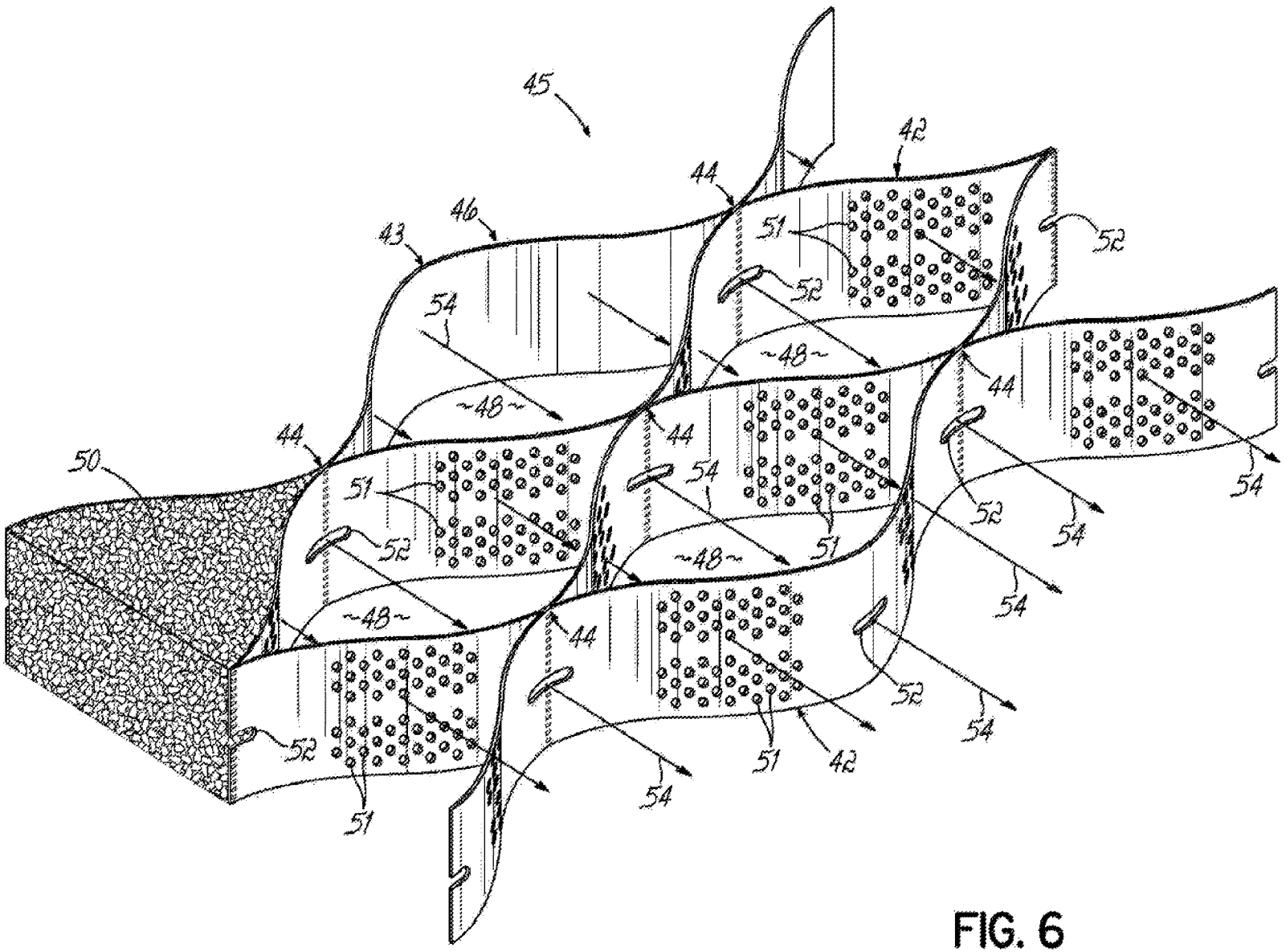
FIG. 6 is an enlarged view of a section of the cellular confinement layer of the drainage system of FIG. 1 in an expanded position partially filled with rocks.

As shown in FIG. 6, the internal panels 42 of matrix 46 are perforated, having openings 51 therein so that water may pass between the rocks 50 and between voids 48 of the expanded matrix 46 of the cellular confinement layer 40 as shown by arrows 54. As shown in FIG. 6, the external panels 43 of expanded matrix 46 (only a portion of one being shown in FIG. 6) are not perforated, so fluid stays inside the expanded matrix 46 of the cellular confinement layer 40. Although the openings 51 are illustrated being circular, the drawings are not intended to be limiting; the openings 51 may be any desired size or shape.

As best shown in FIGS. 6 and 7, each of the internal panels 42 of a section 45 has a plurality of oval-shaped openings 52 located generally along locations 44 where adjacent internal panels 42 are welded together. As best shown in FIG. 7, openings 52 are sized to allow keys 47 to pass through two aligned openings 52 of different sections 45 to join adjacent sections 45. Although the openings 52 are illustrated being oval, the drawings are not intended to be limiting; the openings 52 may be any desired size or shape. Although keys 47 are illustrated being a certain configuration, the keys 47 may be any desired size or shape. The drawings are not intended to be limiting.

As best shown in FIGS. 1 and 2, spaced below the cellular confinement layer 40 are a plurality of perforated collection pipes 56 (only one being shown). As shown in FIG. 2, each of the perforated collection pipes 56 has a circular wall 58 defining a hollow interior 60. Spaced openings 62, shown as circular holes, extend through the wall 58 of the collection pipe 56. However, the openings 62 may be other shapes and sizes and are not intended to be limited by the drawings. Each of the perforated collection pipes 56 preferably has an outer diameter of between twelve (12) to eighteen (18) inches.

Additional rocks 64 surround each of the perforated collection pipes 56 (only one being shown) below the cellular confinement layer 40. The additional rocks 64 are preferably the same types of rocks as those of the cellular confinement layer 40. However, the additional rocks 64 below the cellular confinement layer 40 may be different than the rocks 50 within the cellular confinement layer 40. Fluid from inside the perforated collection pipes 56 (only one being shown) flows into an exit pipe 66 which flows into a collection pond (not shown) for reuse.

The next layer moving from top to bottom is an upper protective layer 68 comprising upper protective sheets 70 sewn together along sewn lines 71 at the site of the drainage system 10. See FIG. 1. Each of the upper protective sheets 70 is preferably made of non-woven geotextile fabric having a weight of ten ounces per square yard available from Hanes Geo Components, a Leggett & Platt Company.

The next layer moving from top to bottom is a liner layer 72 comprising liner sheets 74 welded together along weld lines 75 at the site of the drainage system. The liner sheets 74 are made with high density polyethylene having a thickness of between 40 mils (0.040 inches) and 60 mils (0.060 inches). The liner sheets 74 are not perforated and fluid may not pass through the liner layer 72. The liner sheets 74 are each typically 22.5 feet wide, but may be any desired width. The liner sheets 74, are typically 600 to 900 feet in length, but may be any desired length. The process of heat welding the liner sheets 74 together occurs on site, in other words at the site of the drainage system 10. The liner sheets 74 are trucked onto the site in rolls and unrolled at the site of the drainage system 10. Liner sheets which have proven satisfactory are available from Solmax International Incorporate of Quebec, Canada.

The next layer moving from top to bottom is a lower protective layer 78 comprising lower protective sheets 80 sewn together along sewn lines 76 at the site of the drainage system. Each of the lower protective sheets 80 is preferably made of non-woven geotextile fabric having a weight of eight ounces per square yard available from Hanes Geo Components, a Leggett & Platt company.

The upper and lower protective sheets 70, 80 are each typically fifteen (15) feet wide, but may be any desired width. The upper and lower protective sheets 70, 80 are typically 1500 feet in length, but may be any desired length. The process of sewing the upper and lower protective sheets 70, 80 together occurs on site. In other words, at the site of the drainage system 10. The upper and lower protective sheets 70, 80 are trucked onto the site in rolls and unrolled at the site of the drainage system 10. It is preferable that each of the upper and lower protective sheets 70, 80 be needle punched. However, it is within the scope of the present invention that not all of the upper and lower protective sheets 70, 80 be needle punched.

As best shown in FIG. 4, when the drainage system 10 is fully assembled and ready for operation, a peripheral portion 82 of the top layer 24 extends around the outer edges of the cellular confinement layer 40 and is located inside the anchor trench 14 below the anchor of dirt 20.

Similarly, as best shown in FIG. 4, the woven monofilament geotextile fabric layer 31 has a peripheral portion 84 which extends around the outer edges of the cellular confinement layer 40 and is located inside the anchor trench 14 immediately below the peripheral portion 82 of the top layer 24. The peripheral portion 84 of the woven monofilament geotextile fabric layer 31 is held in place by the anchor of dirt 20 after assembly of the drainage system 10.

As best shown in FIG. 4, when the drainage system 10 is assembled, the cellular confinement layer 40 does not extend into the anchor trench 14. Instead, the cellular confinement layer 40 extends from an inner side wall 16 of one side of the anchor trench 14 to the inner side wall 16 of the other side of the anchor trench 14. In other words, the cellular confinement layer 40 is inside the interior footprint of the anchor trench 14 and does not extend into the anchor trench 14.

As best shown in FIG. 4, when the drainage system 10 is assembled, a peripheral portion 86 of the upper protective layer 68 extends parallel the peripheral portion 84 of the woven monofilament geotextile fabric layer 31 inside the anchor trench 14 below the peripheral portion 84 of the woven monofilament geotextile fabric layer 31. Like the peripheral portions of the layers above and below it, the peripheral portion 86 of the upper protective layer 68 is held in place by the weight of the anchor of dirt 20.

Similarly, the liner layer 72 has a peripheral portion 88 which extends parallel the peripheral portion 86 of the upper protective layer 68 inside the anchor trench 14 below the peripheral portion 84 of the upper protective layer 68. Like the peripheral portions of the layers above and below it, the peripheral portion 88 of the liner layer 72 is held in place by the weight of the anchor of dirt 20 after assembly of the drainage system 10.

Similarly, the lower protective layer 78 has a peripheral portion 90 which extends parallel the peripheral portion 88 of the liner layer 72 inside the anchor trench 14 below the peripheral portion 88 of the liner layer 72 and below the anchor of dirt 20 after assembly of the drainage system 10.

Figure 1A:
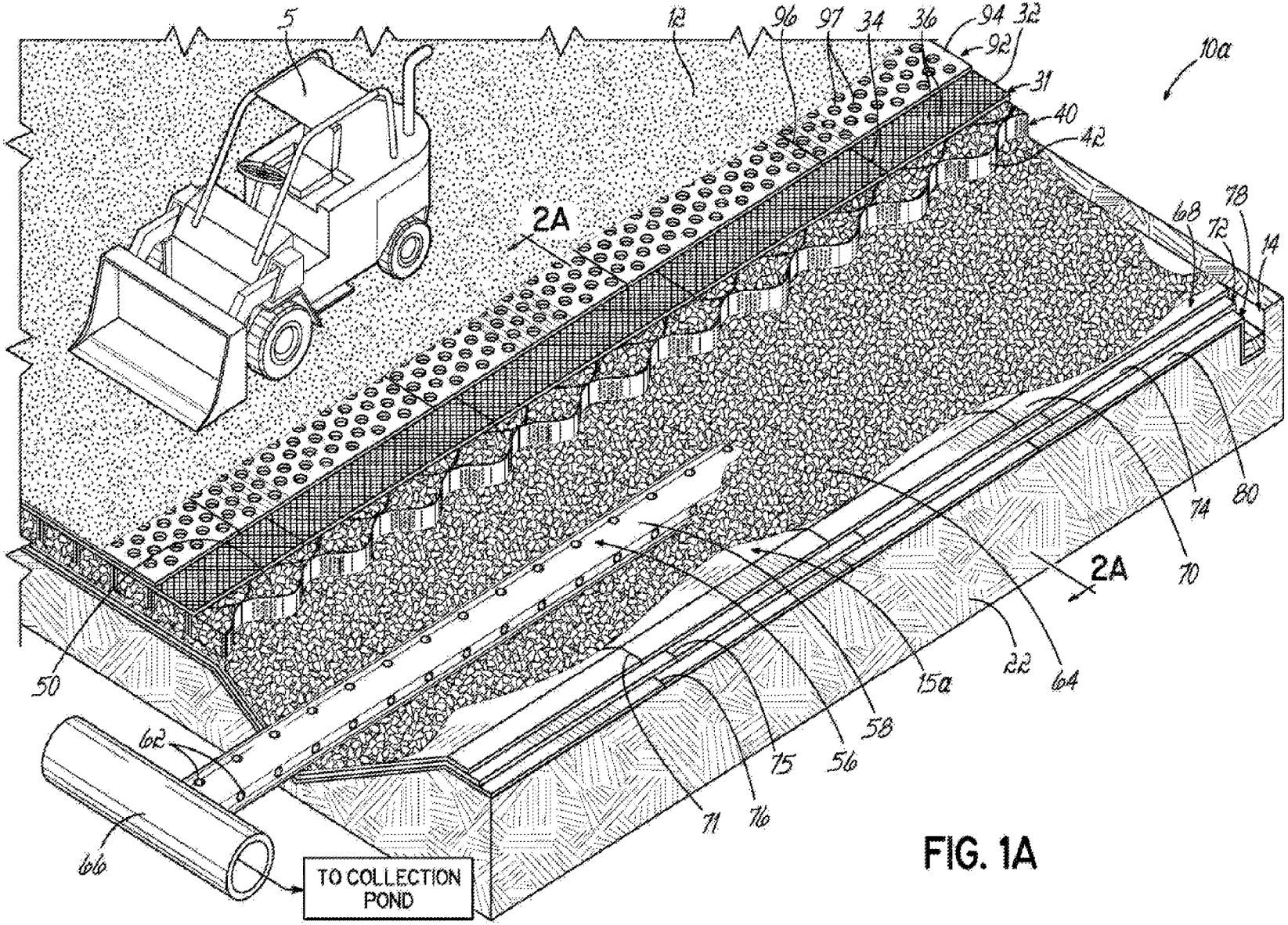
FIG. 1A is a perspective view, partially cut away, of an alternative drainage system.
Figure 2A:
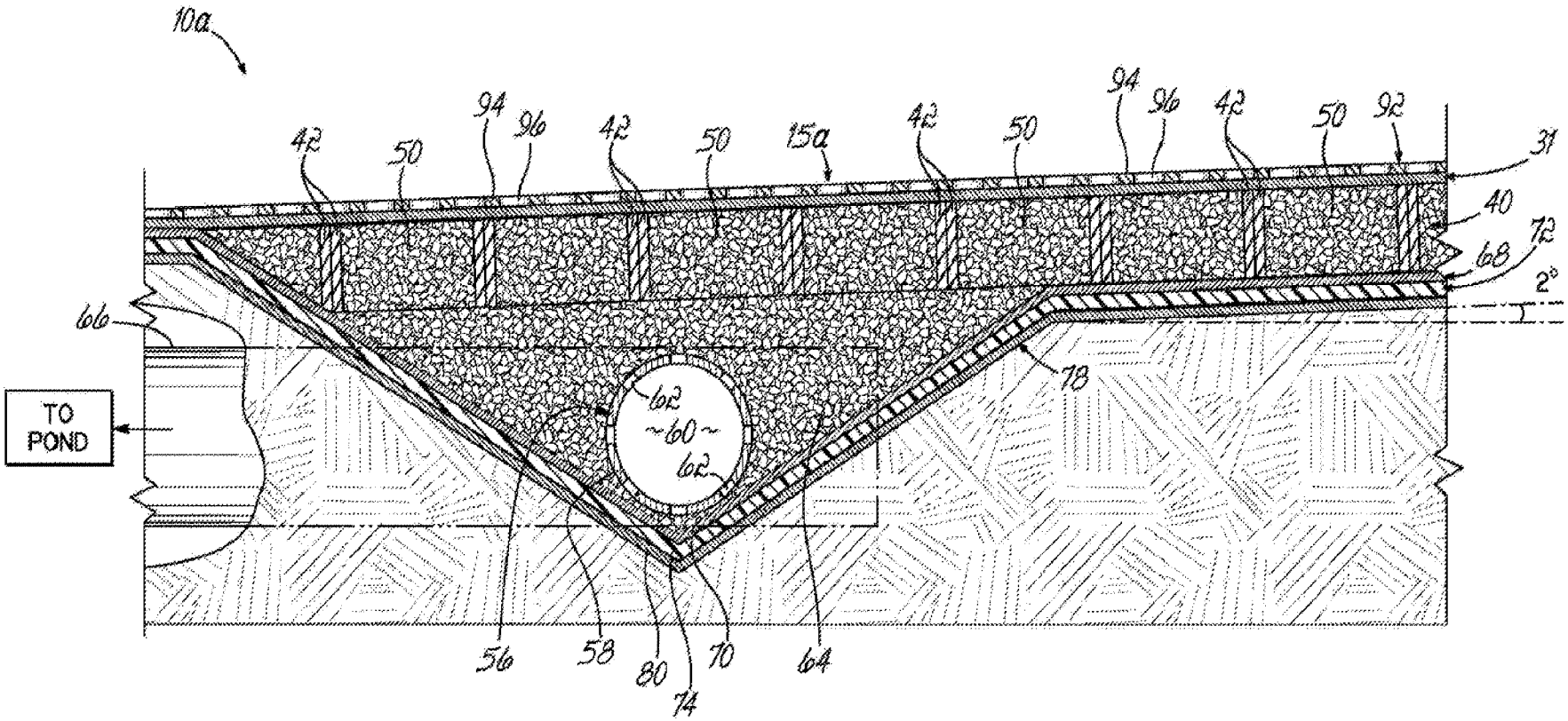
FIG. 2A is a cross-sectional view taken along the line 2A-2A of FIG. 1A.

FIGS. 1A and 2A illustrate an alternative embodiment of drainage system 10*a* having an interior portion 15*a*. Drainage system 10*a* is identical to drainage system 10 shown and described herein with one modification. In place of the top layer 24, a scour stop layer 92 is used as the uppermost layer. The scour stop layer 92 comprises scour stop sheets 94 approximately four feet wide and four feet long which are welded together. However, the scour stop sheets 94 may be any desired length and width. Adjacent scour stop sheets 94 are welded together along weld lines 96. See FIG. 1A. The scour stop sheets 94 are made of one-half inch thick high density polyethylene. Each of the high density polyethylene scour stop sheets 94 has multiple circular openings 97 therethrough, meaning each of the high density polyethylene scour stop sheets 94 is perforated. Although the openings 97 are illustrated being circular, they may be any desired shape and any desired size. The scour stop layer 92 is sturdier than the top layer 24, made of the same plastic material, but more expensive because it is thicker.

Figure 1B:
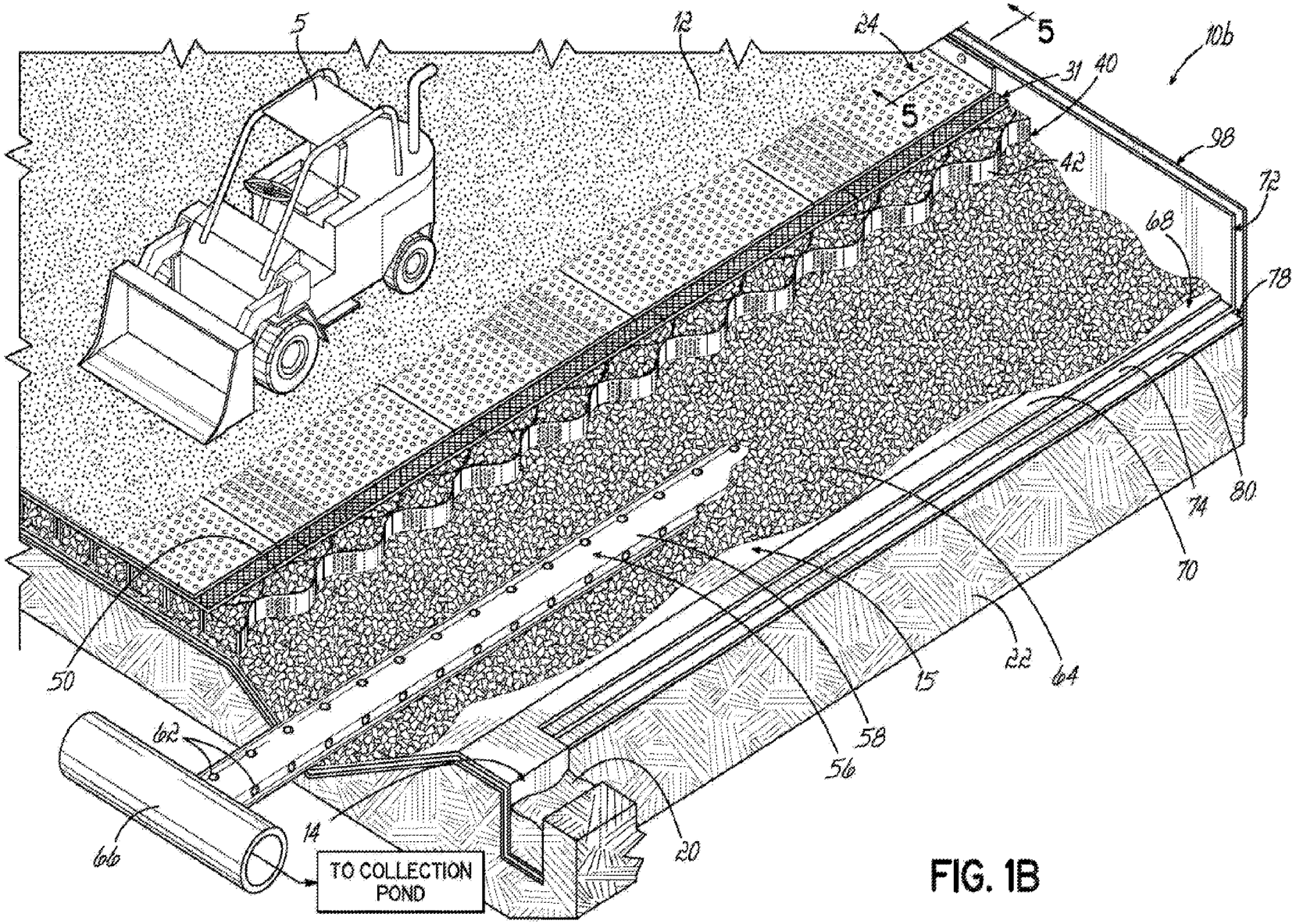
FIG. 1B is a perspective view, partially cut away, of an alternative drainage system.
Figure 5:
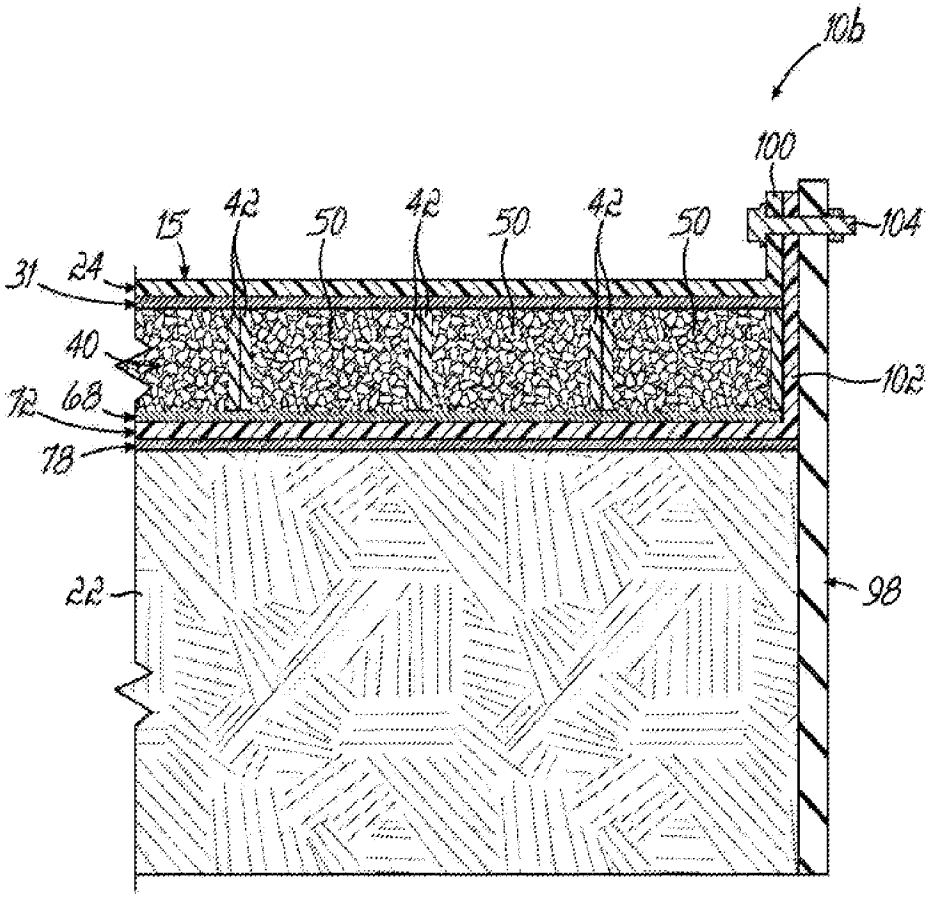
FIG. 5 is a cross-sectional view taken along the line 5-5 of FIG. 1B.

FIGS. 1B and 5 illustrate an alternative embodiment of drainage system 10*b*. Drainage system 10*b* is identical to drainage system 10 shown and described herein with one modification. Rather than an anchor trench 14 surrounding the interior portion 15 of the drainage system, the anchor trench 14 surrounds only three sides of the interior portion 15 of the drainage system. The fourth side of the drainage system 10*b* comprises a support wall 98. As best shown in FIG. 5, a peripheral portion 100 of the top layer 24 and a peripheral portion 102 of the liner layer 72 are connected to the support wall 98 with fasteners 104, such as aluminum or stainless steel batten bar and stainless steel wedge anchors (only one being shown in FIG. 5). Although not shown, any of the layers may be joined to the support wall 98 with any conventional fasteners. This application is not intended to limit in any way the support wall or fasteners used to secure a portion of any of the drainage systems described herein to the support wall.

Although not shown, it is within the scope of the present invention that two or three support walls be used as part of any of the drainage systems described herein.

Figure 3:
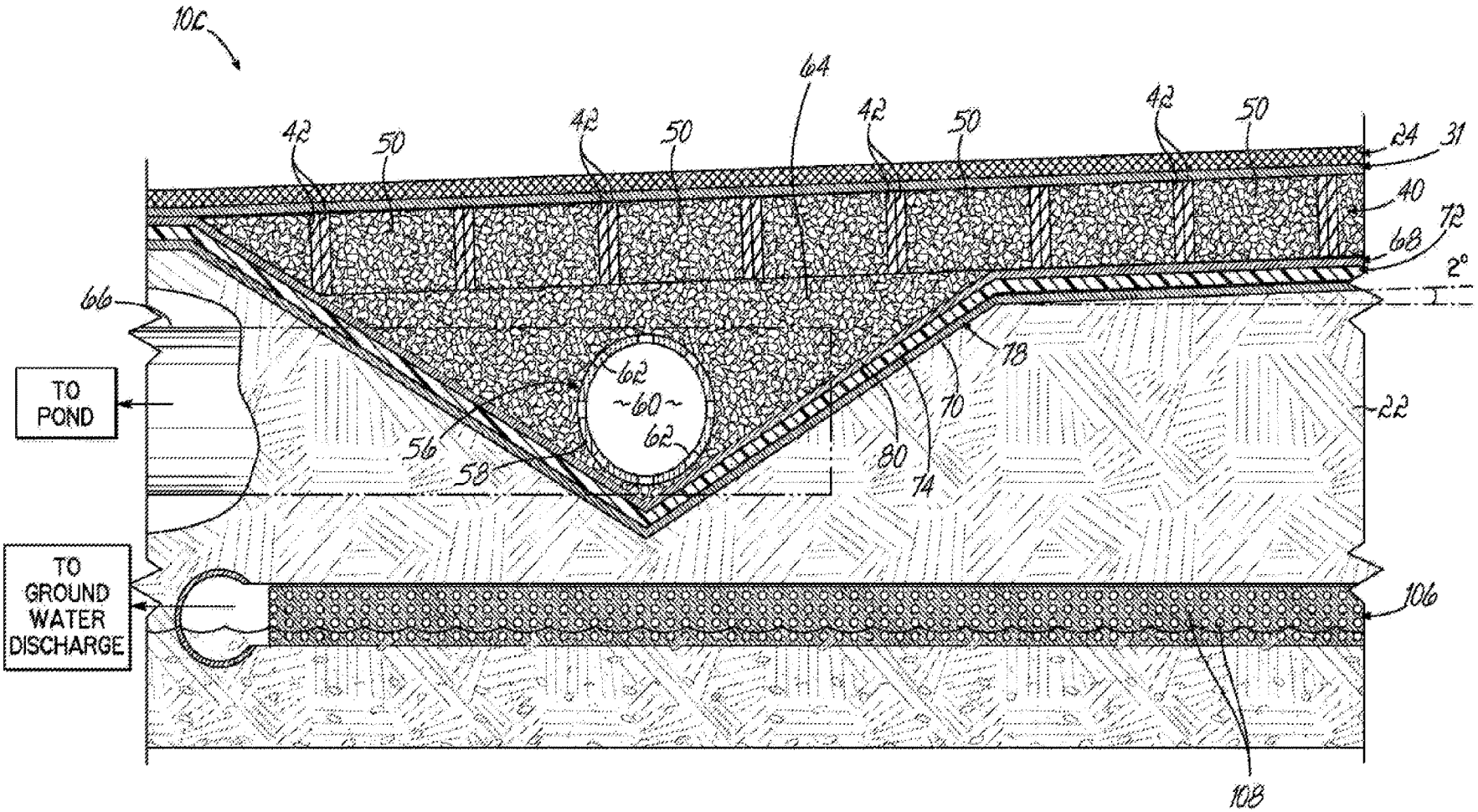
FIG. 3 is a cross-sectional view like FIGS. 2 and 2A showing another embodiment of a drainage system.

FIG. 3 illustrates an alternative embodiment of drainage system 10*c*. Drainage system 10*c* is identical to drainage system 10 shown and described herein with on addition. Drainage system 10*c* has at least one additional perforated discharge pipe 106 in the soil 22 (only one being shown in FIG. 3). Each perforated discharge pipe 106 has openings 108 to collect fluid and transport the fluid to a ground water discharge which may be a ditch or a pond, for example. Although the openings 108 are illustrated being circular, they may be any desired shape and any desired size. Each perforated discharge pipe 106 reduces upwardly directed pressure on the drainage system it is used in and prevents buckling of the drainage system, particularly in areas in which the water table is high. Although one perforated discharge pipe 106 is shown in FIG. 3 being used with a drainage system like drainage system 10, one or more perforated discharge pipes 106 may be used with any of the drainage systems shown or described herein.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. For example, the faces of the boards may show different time periods than those illustrated. The invention resides in each individual feature described herein, alone, and in all combinations of any and all of those features. Accordingly, the scope of the invention shall be limited only by the following claims and their equivalents.

We claim:

1. A method of drying frac sand without heat, said method comprising:

constructing a drainage system comprising a perforated top layer;

a woven monofilament geotextile fabric layer having openings therethrough, the woven geotextile fabric layer being below the perforated top layer and comprising woven monofilament geotextile fabric sheets sewn together;

a cellular confinement layer below the woven monofilament geotextile fabric layer, the cellular confinement layer comprising wave-shaped panels joined together, cells between the wave-shaped panels being filled with rocks;

perforated collection pipes below the cellular confinement layer for capturing liquid and carrying the captured liquid to a collection pond for reuse;

rocks at least partially surrounding the collection pipes;

a watertight liner below the perforated collection pipes and below the cellular confinement layer;

protective layers above and below the watertight liner to prevent the rocks from damaging the watertight liner, the protect layers being made of non-woven geotextile fabric; and placing sand on top of the perforated top layer of the drainage system.

2. The method of claim 1, further comprising passing liquid through the sand to wash the sand, the liquid being collected by the perforated collection pipes for reuse.

3. The method of claim 2, further comprising moving the sand on top of the perforated top layer of the drainage system.

4. A method of drying granular material without heat, said method comprising:

constructing a drainage system comprising a perforated top layer;

a woven monofilament geotextile fabric layer having openings therethrough, the woven geotextile fabric layer being below the perforated top layer and comprising woven monofilament geotextile fabric sheets sewn together;

a cellular confinement layer below the woven monofilament geotextile fabric layer, the cellular confinement layer comprising wave-shaped panels joined together, cells between the wave-shaped panels being filled with rocks;

perforated collection pipes below the cellular confinement layer for capturing liquid and carrying the captured liquid to a collection pond for reuse;

rocks at least partially surrounding the collection pipes;

a watertight liner below the perforated collection pipes and below the cellular confinement layer;

protective layers above and below the watertight liner to prevent the rocks from damaging the watertight liner, the protect layers being made of non-woven geotextile fabric; and placing granular material on top of the perforated top layer of the drainage system.

5. The method of claim 4, further comprising passing liquid through the granular material to wash the granular material, the liquid being collected by the perforated collection pipes for reuse.

6. The method of claim 5, further comprising moving the granular material on top of the perforated top layer of the drainage system.

* * * * *